US007213295B2

(12) United States Patent
Chang

(10) Patent No.: US 7,213,295 B2
(45) Date of Patent: May 8, 2007

(54) TROWEL ASSEMBLY

(76) Inventor: Hsun-Chieh Chang, 58, Ma Yuan West St., Taichung (TW)

( * ) Notice: Subject to any disclaimer, the term of this patent is extended or adjusted under 35 U.S.C. 154(b) by 675 days.

(21) Appl. No.: 10/641,922

(22) Filed: Aug. 12, 2003

(65) Prior Publication Data

US 2005/0034262 A1 Feb. 17, 2005

(51) Int. Cl.
*B05C 17/10* (2006.01)

(52) U.S. Cl. ..... 15/235.4; 15/145; 16/422; 425/458

(58) Field of Classification Search ..... 15/235.8, 15/235.4, 235.3, 145, 245.1; 425/458; 16/422
See application file for complete search history.

(56) References Cited

U.S. PATENT DOCUMENTS

| | | | | | |
|---|---|---|---|---|---|
| 737,831 | A * | 9/1903 | Feraud | ..... | 15/235.4 |
| 1,063,704 | A * | 6/1913 | Linville | ..... | 15/235.8 |
| 2,626,520 | A * | 1/1953 | Whalen | ..... | 15/235.5 |
| 2,771,325 | A * | 11/1956 | Brunson | ..... | 403/389 |
| 3,023,444 | A * | 3/1962 | Tims, Jr. | ..... | 15/235.6 |
| 4,467,492 | A * | 8/1984 | Harrington | ..... | 15/235.4 |
| 4,817,231 | A * | 4/1989 | Ocwieja | ..... | 15/235.4 |
| 5,303,445 | A * | 4/1994 | Meyers | ..... | 15/235.4 |
| 5,333,348 | A * | 8/1994 | Schumacher et al. | ..... | 15/235.4 |
| 5,479,675 | A * | 1/1996 | Pytlewski | ..... | 15/235.4 |
| 5,632,569 | A * | 5/1997 | Szmansky | ..... | 404/97 |
| RE36,463 | E * | 12/1999 | Jarvis | ..... | 15/235.8 |
| 6,032,320 | A * | 3/2000 | McComber et al. | ..... | 15/235.4 |
| 6,499,178 | B1 * | 12/2002 | Huang | ..... | 15/235.4 |

FOREIGN PATENT DOCUMENTS

| | | | |
|---|---|---|---|
| GB | 2236502 | * | 4/1991 |

* cited by examiner

*Primary Examiner*—Gary K. Graham
(74) *Attorney, Agent, or Firm*—Alan D. Kamrath; Nikolai & Mersereau, P.A.

(57) ABSTRACT

A trowel assembly includes a blade plate, a connecting strip fixed on the blade plate and formed with an insertion recess, and a handle mounted on the connecting strip and having a downward extended support post provided with an insertion block inserted into the insertion recess of the connecting strip. Thus, the connecting strip is fixed on the blade plate in a riveting manner, and the handle is combined with the connecting strip in a screwing manner, so that the trowel assembly can be assembled easily, rapidly and conveniently, thereby facilitating the user mounting the trowel assembly.

11 Claims, 9 Drawing Sheets

TROWEL ASSEMBLY

BACKGROUND OF THE INVENTION

1. Field of the Invention

The present invention relates to a trowel assembly, and more particularly to a trowel assembly that can be assembled easily, rapidly and conveniently, thereby facilitating the user mounting the trowel assembly.

2. Description of the Related Art

A conventional trowel assembly in accordance with the prior art shown in FIG. 7 comprises a blade plate 1, a connecting strip 2 fixed on the blade plate 1 by a plurality of rivets 3, and a handle 4 having a front end provided with a support post 4*a* soldered on the connecting strip 2.

However, the handle 4 is fixed on the blade plate 1, so that the handle 4 cannot fit blade plates 1 of different sizes and shapes, thereby limiting the versatility of the conventional trowel assembly. In addition, the conventional trowel assembly has a larger volume in package, thereby increasing costs of transportation.

Another conventional trowel assembly in accordance with the prior art shown in FIGS. 8–12 comprises a blade plate 5, and a handle 6. The blade plate 5 is soldered with three dovetailed seats 5*a*, wherein each of the first and third dovetailed seats 5*a* is formed with a screw bore 5*b*. The handle 6 includes an elongated support seat 6*c*, and a grip 6*b* mounted on the support seat 6*c*. The support seat 6*c* has a bottom formed with a channel 6*d* formed with three dovetailed grooves 6*e* to receive the three dovetailed seats 5*a* of the blade plate 5. The support seat 6*c* has two sides each formed with a through hole 6*g*. The grip 6*b* is formed with a passage hole 6*a* and has two sides each formed with a receiving hole 6*f* for receiving a locking screw 6*h* which is extended through the through hole 6*g* of the support seat 6*c* and screwed into the screw bore 5*b* of the respective dovetailed seat 5*a* of the blade plate 5, so that the handle 6 is fixed on the blade plate 5. Thus, the handle 6 can fit blade plates 5 of different sizes and shapes, and the trowel assembly has a smaller volume in package, thereby decreasing costs of transportation.

However, the concrete or cement easily enters the channel 6*d* of the support seat 6*c* of the handle 6, so that the handle 6 is fixed on the blade plate 5 without detachment when the concrete or cement is solidified. In addition, it is necessary to form three dovetailed seats 5*a* on the blade plate 5 without deviation so as to fit the three dovetailed grooves 6*e* of the support seat 6*c* of the handle 6, thereby greatly increasing difficulty in the working process.

SUMMARY OF THE INVENTION

The primary objective of the present invention is to provide a trowel assembly, wherein the connecting strip is fixed on the blade plate in a riveting manner, and the handle is combined with the connecting strip in a screwing manner, so that the trowel assembly can be assembled easily, rapidly and conveniently, thereby facilitating the user mounting the trowel assembly.

Another objective of the present invention is to provide a trowel assembly that has a simplified construction, thereby decreasing costs of fabrication.

A further objective of the present invention is to provide a trowel assembly, wherein the insertion block of the support post of the handle and the insertion recess of the connecting strip have a tapered shape to provide a guiding effect, so that the insertion block of the support post of the handle can be inserted into the insertion recess of the connecting strip easily and conveniently, thereby facilitating the user mounting the trowel assembly.

A further objective of the present invention is to provide a trowel assembly, wherein the insertion block of the support post of the handle is fixed in the insertion recess of the connecting strip rigidly and stably, so that the handle is combined with the insertion recess of the connecting strip rigidly and stably.

In accordance with the present invention, there is provided a trowel assembly, comprising:

a blade plate;

a connecting strip fixed on the blade plate and formed with an insertion recess; and a handle mounted on the connecting strip and having a front end provided with a downward extended support post having a lower end provided with an insertion block inserted into the insertion recess of the connecting strip.

Further benefits and advantages of the present invention will become apparent after a careful reading of the detailed description with appropriate reference to the accompanying drawings.

DETAILED DESCRIPTION OF THE INVENTION

Figure 1:
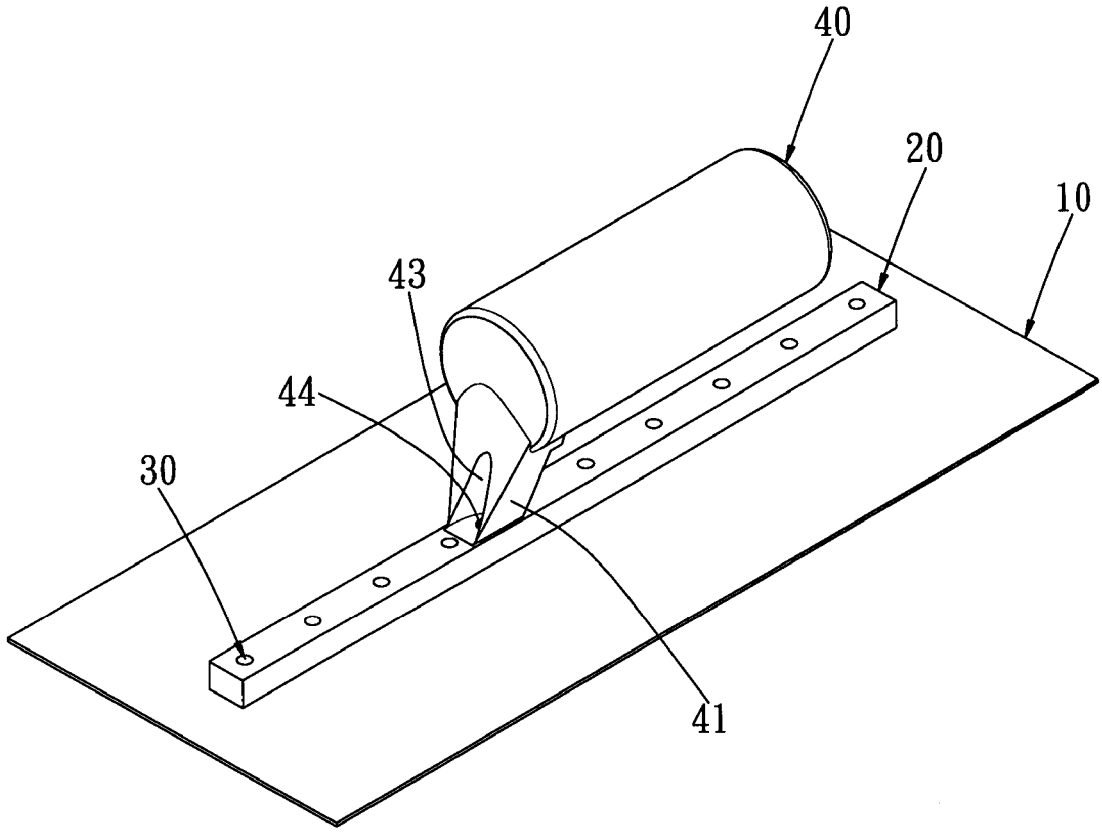
FIG. 1 is a perspective view of a trowel assembly in accordance with the preferred embodiment of the present invention.
Figure 2:
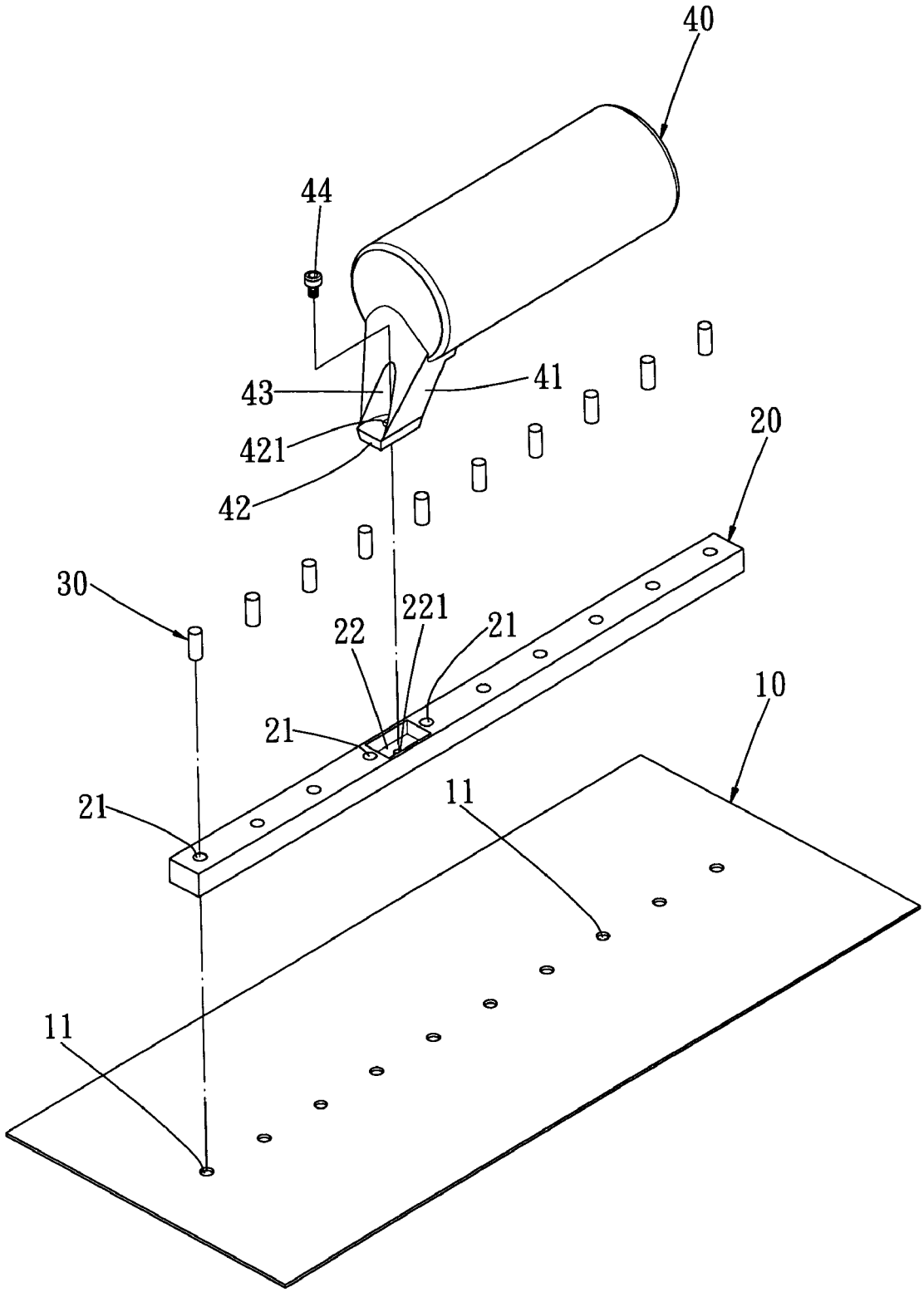
FIG. 2 is an exploded perspective view of the trowel assembly as shown in FIG. 1.
Figure 3:
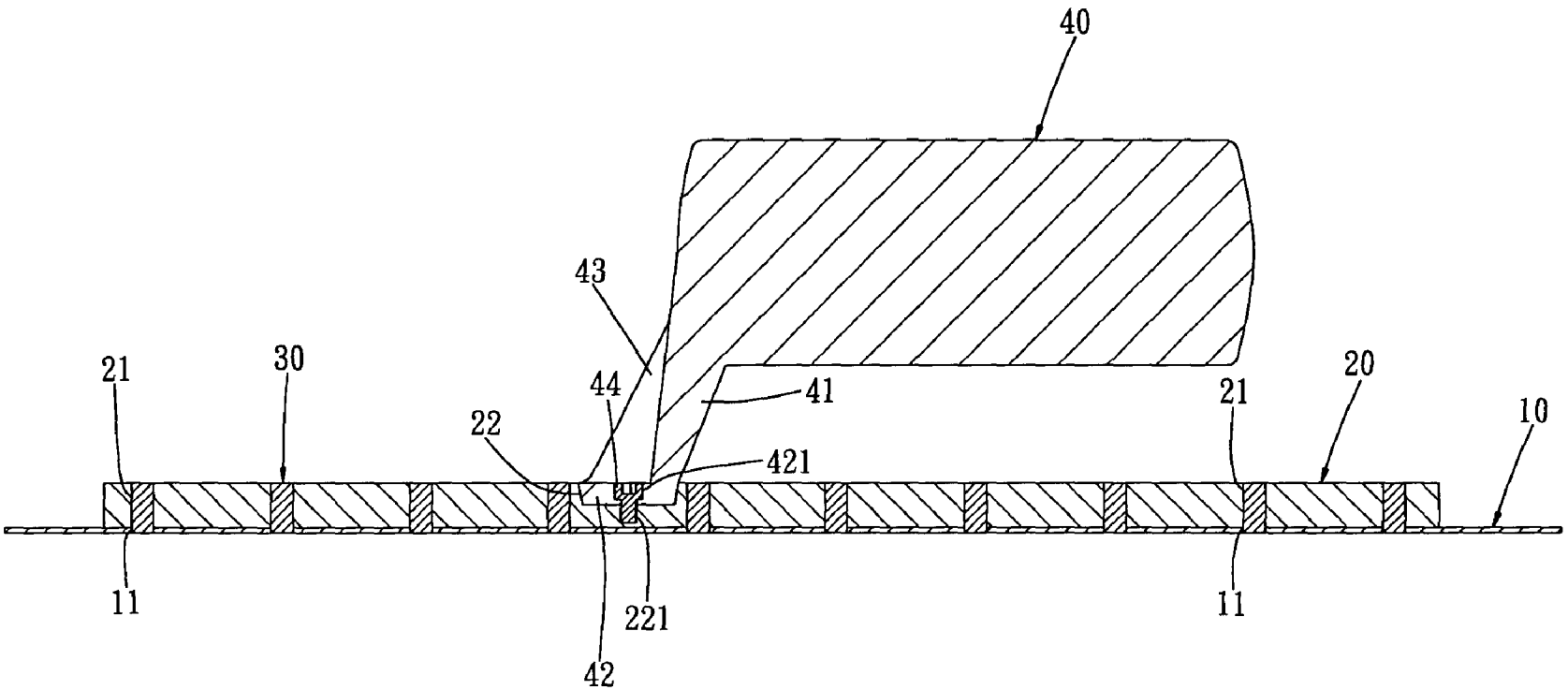
FIG. 3 is a plan cross-sectional view of the trowel assembly as shown in FIG. 1.

Referring to the drawings and initially to FIGS. 1–3, a trowel assembly in accordance with the preferred embodiment of the present invention comprises a blade plate 10, a connecting strip 20, a plurality of rivets 30, and a handle 40.

The blade plate 10 is formed with a plurality of fixing holes 11 equally spaced from each other.

The connecting strip 20 is fixed on the blade plate 10 and is formed with a plurality of riveting holes 21 each aligning with a respective one of the fixing holes 11 of the blade plate 10. The connecting strip 20 is formed with an insertion recess 22. Preferably, the insertion recess 22 of the connecting strip 20 is located between two adjacent riveting holes 21 and has a rectangular tapered shape. In addition, the insertion recess 22 of the connecting strip 20 has a bottom face having a center formed with a screw bore 221.

Each of the rivets 30 is extended through a respective one of the riveting holes 21 of the connecting strip 20 and is riveted into a respective one of the fixing holes 11 of the blade plate 10, so that the connecting strip 20 is fixed on the blade plate 10 by the rivets 30.

The handle 40 is mounted on the connecting strip 20 and has a front end provided with a downward extended support post 41 having a lower end provided with an insertion block 42 inserted into the insertion recess 22 of the connecting strip 20. The support post 41 of the handle 40 has a side formed with an opening 43 located above the insertion block 42 so as to expose the insertion block 42. Preferably, the insertion block 42 of the support post 41 of the handle 40 has a rectangular tapered shape to mate with that of the insertion recess 22 of the connecting strip 20. In addition, the insertion block 42 of the support post 41 of the handle 40 is formed with a counterbore 421 aligning with the screw bore 221 of the insertion recess 22 of the connecting strip 20. Preferably, the counterbore 421 of the insertion block 42 of the support post 41 of the handle 40 communicates with the opening 43 of the support post 41 of the handle 40.

The trowel assembly further comprises a locking screw 44 extended through the counterbore 421 of the insertion block 42 of the support post 41 of the handle 40 and screwed into the screw bore 221 of the insertion recess 22 of the connecting strip 20, so that the insertion block 42 of the support post 41 of the handle 40 is fixed in the insertion recess 22 of the connecting strip 20.

Figure 4:
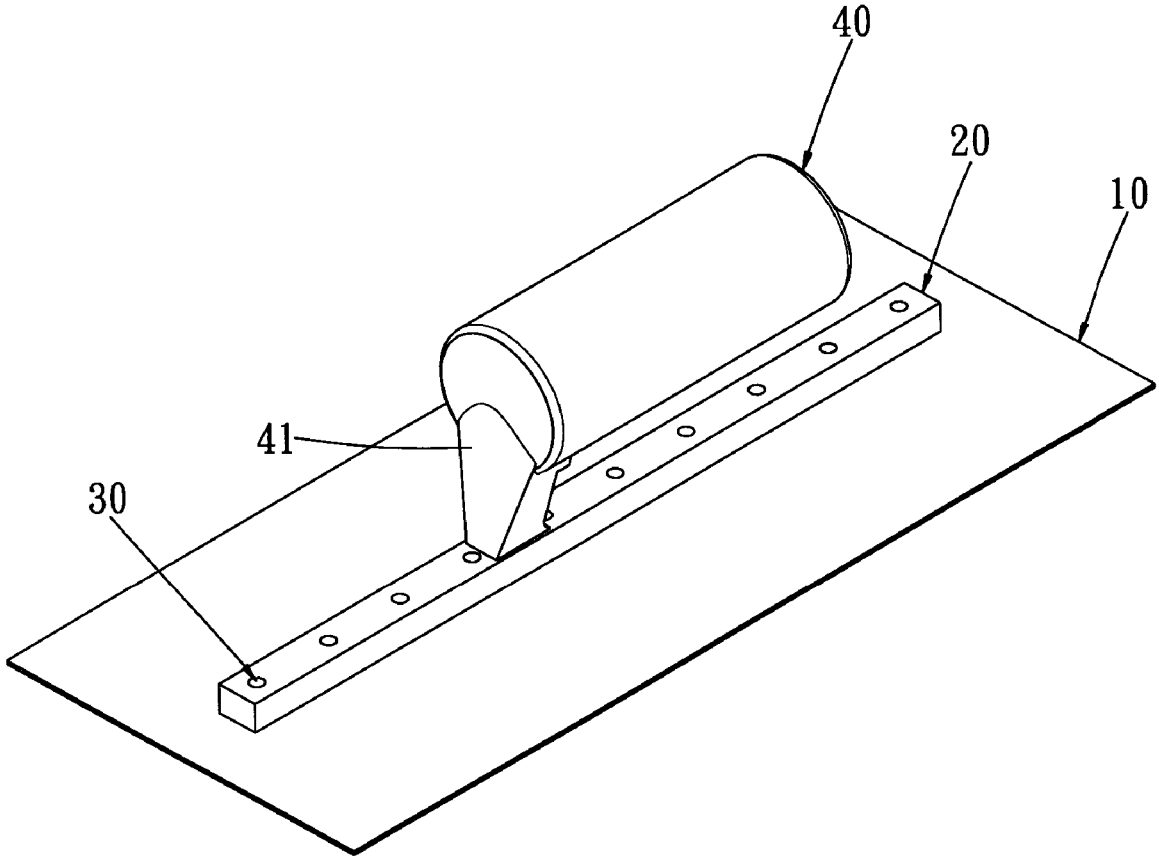
FIG. 4 is a perspective view of a trowel assembly in accordance with another embodiment of the present invention.
Figure 5:
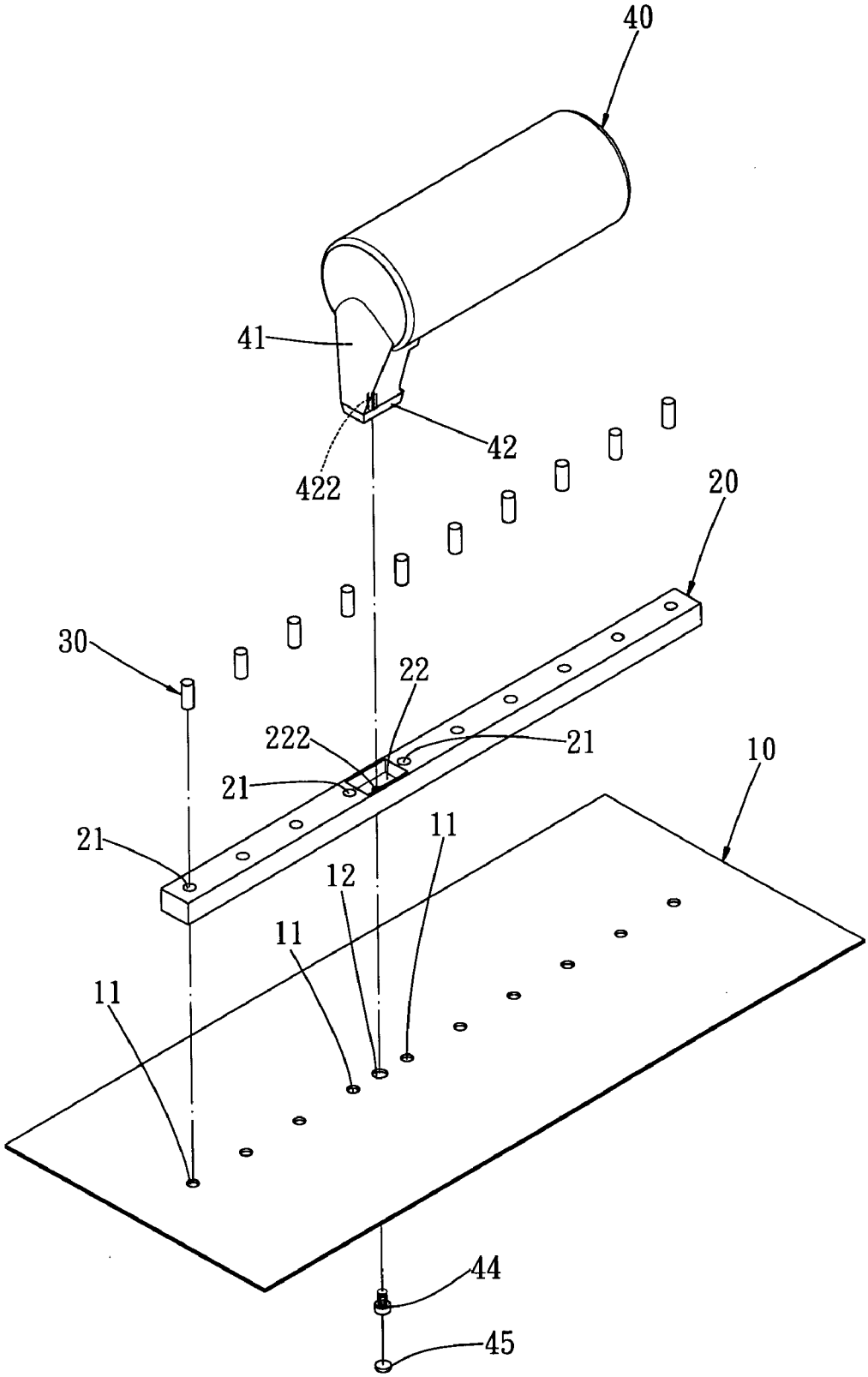
FIG. 5 is an exploded perspective view of the trowel assembly as shown in FIG. 4.
Figure 6:
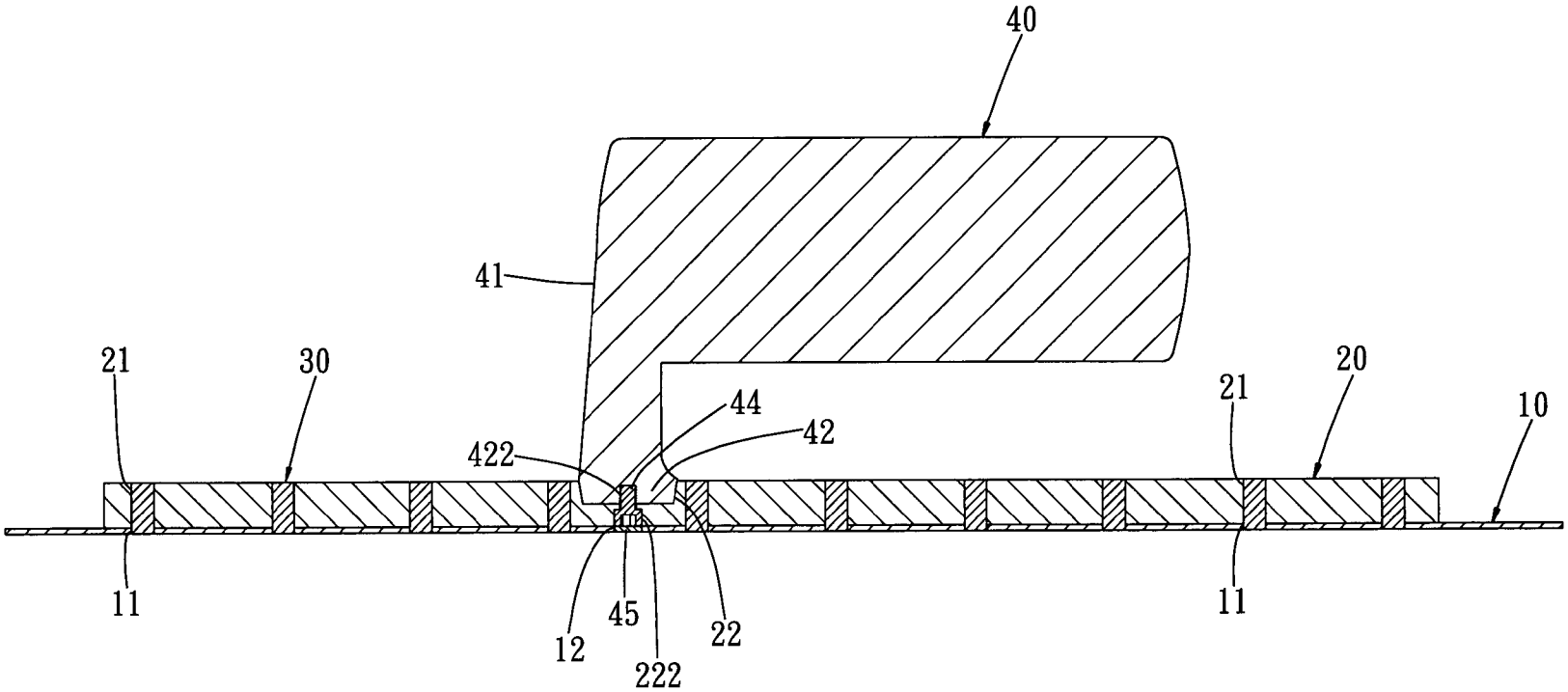
FIG. 6 is a plan cross-sectional view of the trowel assembly as shown in FIG. 4.
Figure 7:
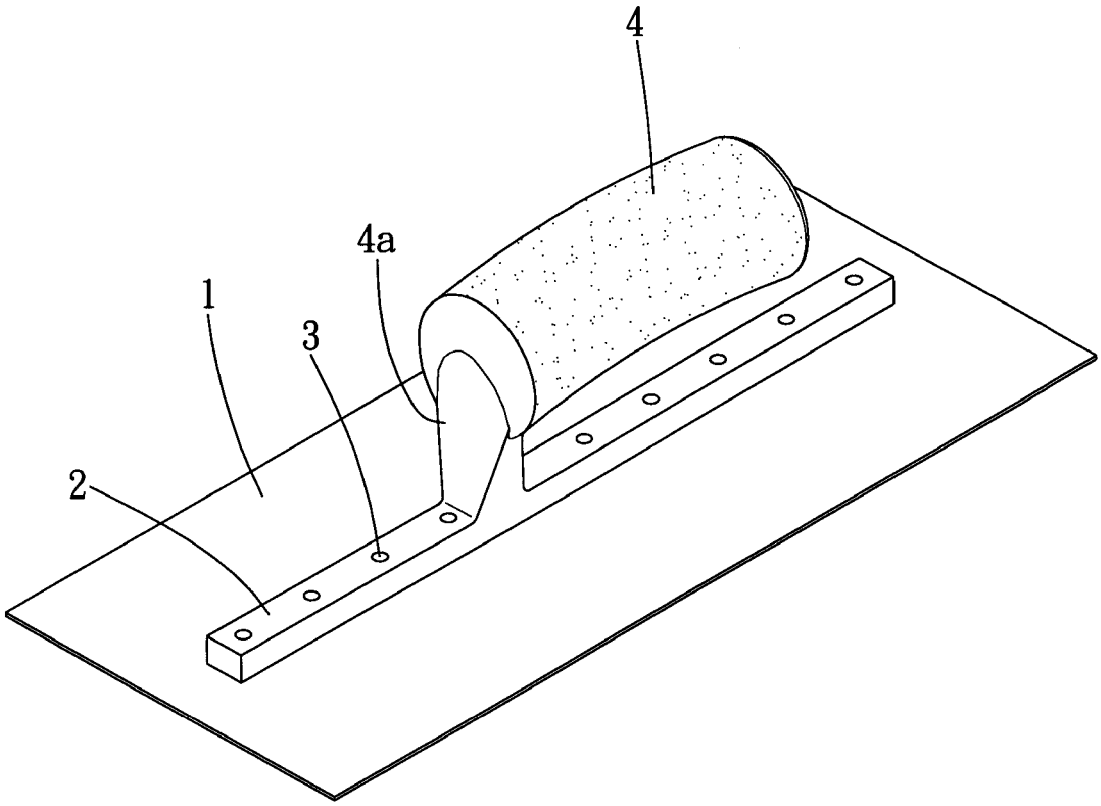
FIG. 7 PRIOR ART
FIG. 7 is a perspective view of a conventional trowel assembly in accordance with the prior art.
Figure 8:
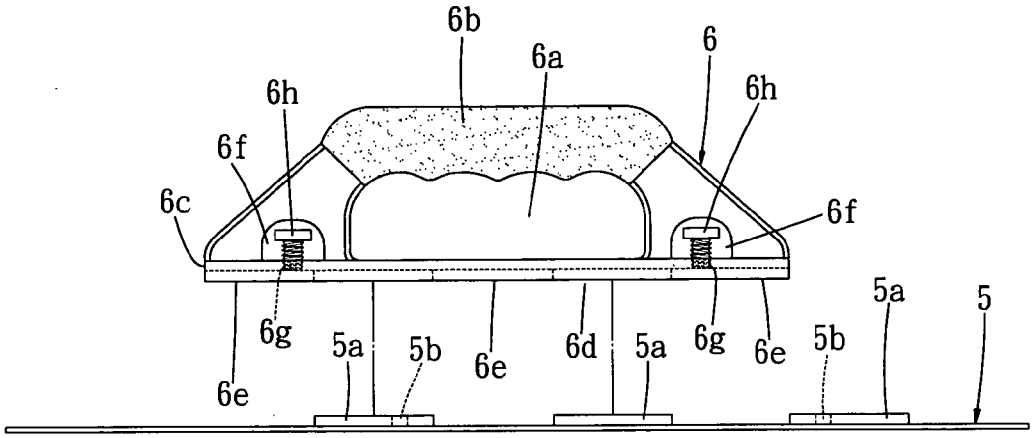
FIG. 8 PRIOR ART
FIG. 8 is a plan exploded view of another conventional trowel assembly in accordance with the prior art.
Figure 9:
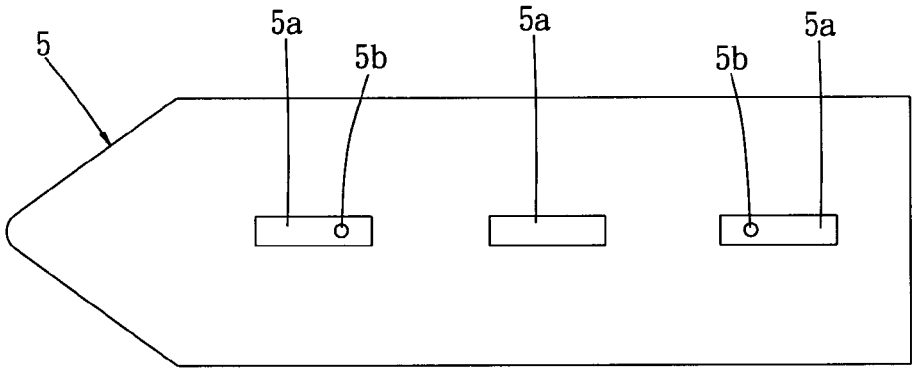
FIG. 9 PRIOR ART
FIG. 9 is a top plan view of a blade plate of the conventional trowel assembly as shown in FIG. 8.
Figure 10:
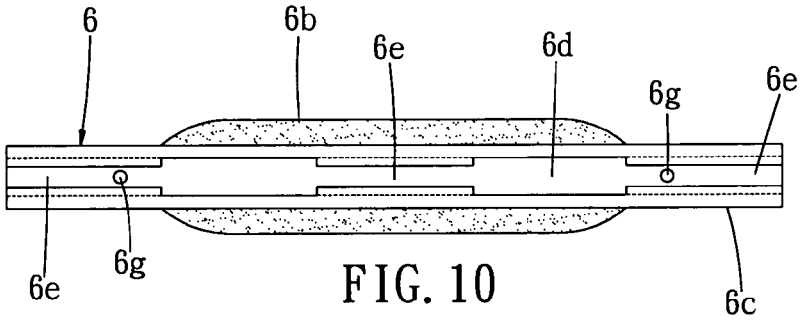
FIG. 10 PRIOR ART
FIG. 10 is a bottom plan view of a handle of the conventional trowel assembly as shown in FIG. 8.
Figure 11:
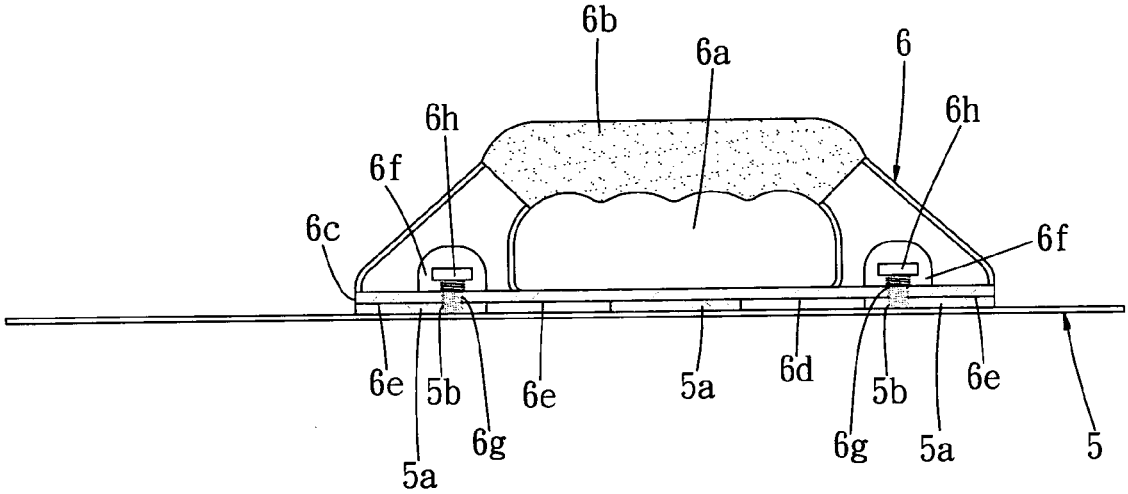
FIG. 11 PRIOR ART
FIG. 11 is a cross-sectional assembly view of the conventional trowel assembly as shown in FIG. 8.
Figure 12:
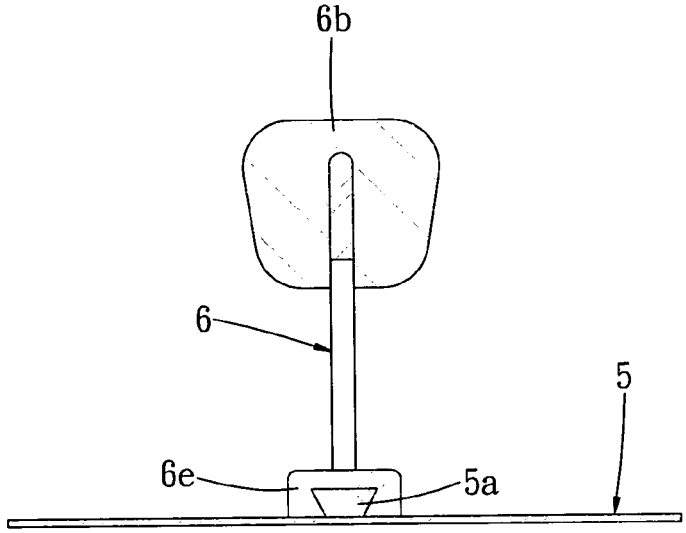
FIG. 12 PRIOR ART
FIG. 12 is a side plan cross-sectional view of the conventional trowel assembly as shown in FIG. 11.

Referring to FIGS. 4–6, in accordance with another embodiment of the present invention, the blade plate 10 is formed with a through hole 12 located between two adjacent fixing holes 11. In addition, the insertion recess 22 of the connecting strip 20 has a bottom face having a center formed with a stepped hole 222 aligning with the through hole 12 of the blade plate 10. Preferably, the stepped hole 222 has an upper portion having a smaller diameter and a lower portion having a greater diameter. In addition, the insertion block 42 of the support post 41 of the handle 40 has a bottom face formed with a screw bore 422 aligning with the stepped hole 222 of the insertion recess 22 of the connecting strip 20.

The trowel assembly further comprises a locking screw 44 extended through the through hole 12 of the blade plate 10 and the stepped hole 222 of the insertion recess 22 of the connecting strip 20, and screwed into the screw bore 422 of the insertion block 42 of the support post 41 of the handle 40, so that the insertion block 42 of the support post 41 of the handle 40 is fixed in the insertion recess 22 of the connecting strip 20. The trowel assembly further comprises a cover 45 inserted into the through hole 12 of the blade plate 10 to seal the locking screw 44.

Accordingly, the connecting strip 20 is fixed on the blade plate 10 in a riveting manner, and the handle 40 is combined with the connecting strip 20 in a screwing manner, so that the trowel assembly can be assembled easily, rapidly and conveniently, thereby facilitating the user mounting the trowel assembly. In addition, the trowel assembly has a simplified construction, thereby decreasing costs of fabrication. Further, the insertion block 42 of the support post 41 of the handle 40 and the insertion recess 22 of the connecting strip 20 have a tapered shape to provide a guiding effect, so that the insertion block 42 of the support post 41 of the handle 40 can be inserted into the insertion recess 22 of the connecting strip 20 easily and conveniently, thereby facilitating the user mounting the trowel assembly. Further, the insertion block 42 of the support post 41 of the handle 40 is fixed in the insertion recess 22 of the connecting strip 20 rigidly and stably, so that the handle 40 is combined with the insertion recess 22 of the connecting strip 20 rigidly and stably.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A trowel assembly, comprising:

a blade plate;

a connecting strip fixed on the blade plate and formed with an insertion recess; and a handle mounted on the connecting strip and having a front end provided with a downward extended support post having a lower end provided with an insertion block inserted into the insertion recess of the connecting strip;

wherein the insertion recess of the connecting strip has a bottom face having a center formed with a screw bore, the insertion block of the support post of the handle is formed with a counterbore aligning with the screw bore of the insertion recess of the connecting strip, and the trowel assembly further comprises a locking screw extended through the counterbore of the insertion block of the support post of the handle and screwed into the screw bore of the insertion recess of the connecting strip, so that the insertion block of the support post of the handle is fixed in the insertion recess of the connecting strip.

2. The trowel assembly in accordance with claim 1, wherein the insertion recess of the connecting strip has a rectangular tapered shape, and the insertion block of the support post of the handle has a rectangular tapered shape to mate with that of the insertion recess of the connecting strip.

3. The trowel assembly in accordance with claim 1, wherein the support post of the handle has a side formed with an opening located above the insertion block so as to expose the insertion block.

4. The trowel assembly in accordance with claim 3, wherein the counterbore of the insertion block of the support post of the handle communicates with the opening of the support post of the handle.

5. The trowel assembly in accordance with claim 1, wherein the connecting strip is formed with a plurality of riveting holes, and the insertion recess of the connecting strip is located between two adjacent riveting holes.

6. The trowel assembly in accordance with claim 1, wherein the connecting strip is fixed on the blade plate in a riveting manner.

7. The trowel assembly in accordance with claim 1, wherein the handle is combined with the connecting strip in a screwing manner.

8. A trowel assembly, comprising:

a blade plate:

a connecting strip fixed on the blade plate and formed with an insertion recess; and a handle mounted on the connecting strip and having a front end provided with a downward extended support post having a lower end provided with an insertion block inserted into the insertion recess of the connecting strip;

wherein the blade plate is formed with a through hole, the insertion recess of the connecting strip has a bottom face having a center formed with a stepped hole aligning with the through hole of the blade plate, the insertion block of the support post of the handle has a bottom face formed with a screw bore aligning with the stepped hole of the insertion recess of the connecting strip, and the trowel assembly further comprises a locking screw extended through the through hole of the blade plate and the stepped hole of the insertion recess of the connecting strip, and screwed into the screw bore of the insertion block of the support post of the handle, so that the insertion block of the support post of the handle is fixed in the insertion recess of the connecting strip.

9. The trowel assembly in accordance with claim 8, further comprising a cover inserted into the through hole of the blade plate to seal the locking screw.

10. The trowel assembly in accordance with claim 8, wherein the stepped hole has an upper portion having a diameter and a lower portion having a diameter greater than that of the upper portion.

11. The trowel assembly in accordance with claim 8, wherein the blade plate is formed with a plurality of fixing holes equally spaced from each other, and the through hole of the blade plate is located between two adjacent fixing holes.

* * * * *